US009456961B2

(12) United States Patent
Duineveld et al.

(10) Patent No.: US 9,456,961 B2
(45) Date of Patent: Oct. 4, 2016

(54) TEAT

(75) Inventors: Paulus Cornelis Duineveld, Drachten (NL); Carolien Willemijn Geijzendorffer, Mussel (NL); Fokke Roelof Voorhorst, Drachten (NL); Johannes Tseard Van Der Kooi, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 804 days.

(21) Appl. No.: 12/863,223

(22) PCT Filed: Jan. 20, 2009

(86) PCT No.: PCT/IB2009/050198

§ 371 (c)(1),
(2), (4) Date: Jul. 16, 2010

(87) PCT Pub. No.: WO2009/093173

PCT Pub. Date: Jul. 30, 2009

(65) Prior Publication Data

US 2010/0308001 A1 Dec. 9, 2010

(30) Foreign Application Priority Data

Jan. 25, 2008 (EP) ..... 08150657

(51) Int. Cl.

| | |
|---|---|
| ***A61J 17/00*** | (2006.01) |
| ***A61J 11/00*** | (2006.01) |
| ***A61J 11/04*** | (2006.01) |

(52) U.S. Cl.

CPC ..... *A61J 11/005* (2013.01); *A61J 11/045* (2013.01)

(58) Field of Classification Search

CPC ..... A61J 11/00; A61J 11/045; A61J 11/005; A61J 11/0035; A61J 11/0045; A61J 11/006; A61J 11/0065; A61J 11/001; A61J 11/0015; A61J 1/003; A61J 11/0055; A61J 17/00; A61J 17/007; A61J 17/02; A61J 11/007; A61J 11/02

USPC ..... 606/234–236; 128/848; D24/194; 215/11.1–11.5

See application file for complete search history.

(56) References Cited

U.S. PATENT DOCUMENTS

| | | | | |
|---|---|---|---|---|
| 2,366,214 | A | 1/1945 | Ramaker | |
| 4,505,398 | A | 3/1985 | Kesselring | |
| 4,623,069 | A * | 11/1986 | White | 215/11.1 |
| 5,300,089 | A * | 4/1994 | Sassin | 606/236 |
| 6,241,110 | B1 | 6/2001 | Hakim | |
| 6,699,264 | B1 | 3/2004 | Rohrig | |
| 6,863,681 | B2 * | 3/2005 | Dickerson | 606/235 |
| 6,968,964 | B2 * | 11/2005 | Gilmore | 215/11.1 |

(Continued)

FOREIGN PATENT DOCUMENTS

| | | | |
|---|---|---|---|
| EP | 2191808 | A2 * | 6/2010 |
| GB | 2215318 | A * | 9/1989 |
| WO | 9704736 | A1 | 2/1997 |

OTHER PUBLICATIONS

MAnuskiatti et al. "Influence of age, anatomic site and race on skin roughness and scaliness", Dermatology, 196, 401-407.*

*Primary Examiner* — Jonathan Miles
*Assistant Examiner* — Kendra Obu

(57) ABSTRACT

A teat includes a stem and a nipple, in which a structured area has an undulating surface on at least a partial region of the stem or nipple. The surface roughness of the undulating surface being greater than 100 μm.

4 Claims, 8 Drawing Sheets

(56) References Cited

U.S. PATENT DOCUMENTS

| | | | | |
|---|---|---|---|---|
| 7,122,045 | B2 | 10/2006 | Randolph | |
| 2004/0182813 | A1 | 9/2004 | Gilmore | |
| 2004/0220618 | A1 | 11/2004 | Rohrig | |
| 2005/0082301 | A1* | 4/2005 | Verbovszky | 220/717 |
| 2006/0069409 | A1* | 3/2006 | Morris | A61J 17/00 606/234 |
| 2006/0201901 | A1* | 9/2006 | Sabree et al. | 215/11.1 |
| 2007/0068890 | A1* | 3/2007 | Rohrig | 215/11.1 |
| 2007/0208380 | A1* | 9/2007 | Ebner | A46B 9/005 606/235 |

* cited by examiner

TEAT

FIELD OF THE INVENTION

The present invention relates to a teat comprising a stem and a nipple, in which a structured area comprising an undulating surface is provided on at least a partial region of the stem or the nipple.

BACKGROUND OF THE INVENTION

Teats are used for artificial feeding and are commonly used with feeding bottles for supplying milk to children. For example, a conventional teat may cooperate with the lid of a feeding bottle to provide a means through which milk stored in the bottle can be supplied to a child.

SUMMARY OF THE INVENTION

It is advantageous for such teats to simulate a mother's breast, as it is known that children generally prefer the experience of feeding from their mother's breast to that of feeding from a conventional teat. It is thought that this preference is due to the differences in shape, texture and appearance between a mother's breast and a conventional feeding teat and, although attempts have made to develop teats to address this problem, conventional and prior art teats have so far insufficiently been able to imitate all of the above characteristics of a mother's breast.

According to the invention, there is provided a teat comprising a stem and a nipple, wherein a structured area comprising an undulating surface is provided on at least a partial region of the stem or nipple, the surface roughness of the undulating surface being greater than 100 μm.

The surface roughness $R_z$ of the undulating surface may be at least 120 μm.

The surface roughness $R_z$ of the undulating surface may be 600 μm or less.

The undulating surface may comprise a plurality of elevated regions and a plurality of depressed regions and the average distance between adjacent elevated regions may be at least 200 μm.

The elevated regions of the undulating surface may have varying geometric properties.

The average distance between adjacent elevated regions may be equal to or less than 20 mm.

The average distance between adjacent elevated regions may be equal to or less than 3 mm.

The average distance between adjacent elevated regions may be equal to or less than 1 mm.

The undulating surface may comprise a secondary structured area comprising a secondary undulating surface.

The secondary undulating surface may comprise a plurality of elevated regions and a plurality of depressed regions.

The average distance between adjacent elevated regions of the undulating surface may be greater than the average distance between adjacent elevated regions of the secondary undulating surface.

The average distance between adjacent elevated regions of the secondary undulating surface may be 100 μm or less.

The elevated regions of the secondary undulating surface may have varying geometric properties.

The structured area may be provided on an external region of a wall of the stem or nipple, and an internal region of the wall may have a profile which substantially matches the profile of the structured area.

The teat may be adapted to cooperate with a feeding bottle.

BRIEF DESCRIPTION OF THE DRAWINGS

Embodiments of the invention will now be described, by way of example, with reference to the accompanying drawings in which.

DETAILED DESCRIPTION OF THE EMBODIMENTS

Figure 1:
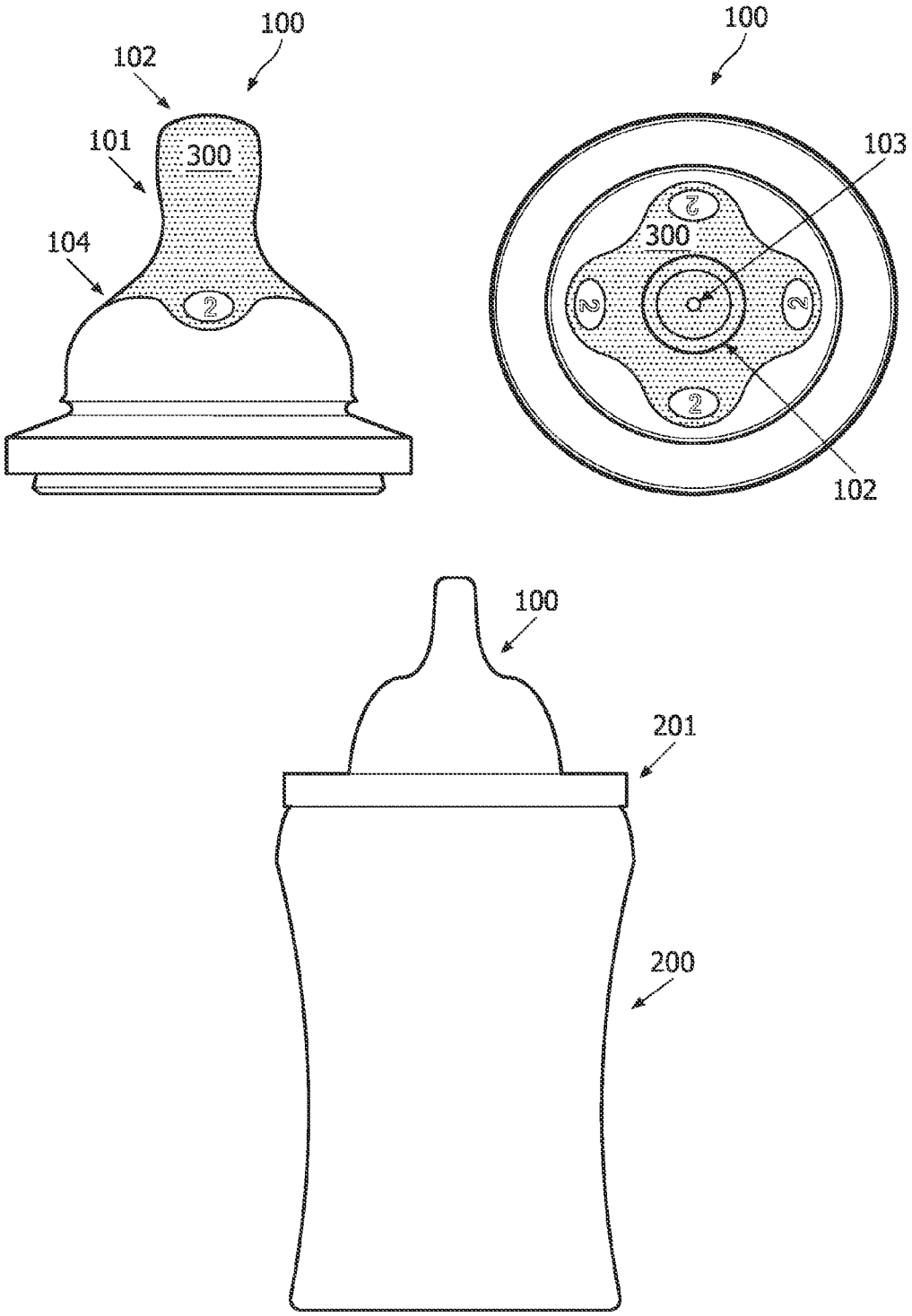
FIG. 1 is a side-view and a plan-view of a teat having a stem, nipple and structured area, and a teat in cooperation with a lid of a feeding bottle.

A teat 100 suitable for supplying milk to a baby, infant or child is shown in FIG. 1. The teat 100 is adapted to cooperate with a feeding bottle 200, for example by cooperating with a lid 201 of the feeding bottle 200. The teat 100 may additionally be adapted such that it is easily detached from the lid 201 for cleaning purposes.

As is shown by FIG. 1, the teat 100 comprises a stem 101 and a nipple 102, through which milk or other fluid may pass. For example, milk or fluid may pass through one or more feeding openings 103 in the nipple 102 when a pressure difference is created between the interior and exterior of the nipple 102. This pressure difference may be created by a child sucking on the teat 100.

A structured area 300 is provided on at least a partial region of an exterior surface 104 of the stem 101 or nipple 102 of the teat 100. An example of the structured area 300 is shown by the shaded area in FIG. 1. The structured area 300 may comprise an undulating surface 301 including a plurality of sloping regions 302, a plurality of elevated regions 303 and a plurality of depressed regions 304. A first example of a section of such an undulating surface 301 is shown in two-dimensions and three-dimensions by FIG. 2 and FIG. 3 respectively, in which the sloping regions 302, elevated regions 303 and depressed regions 304 can be clearly identified.

Figure 3:
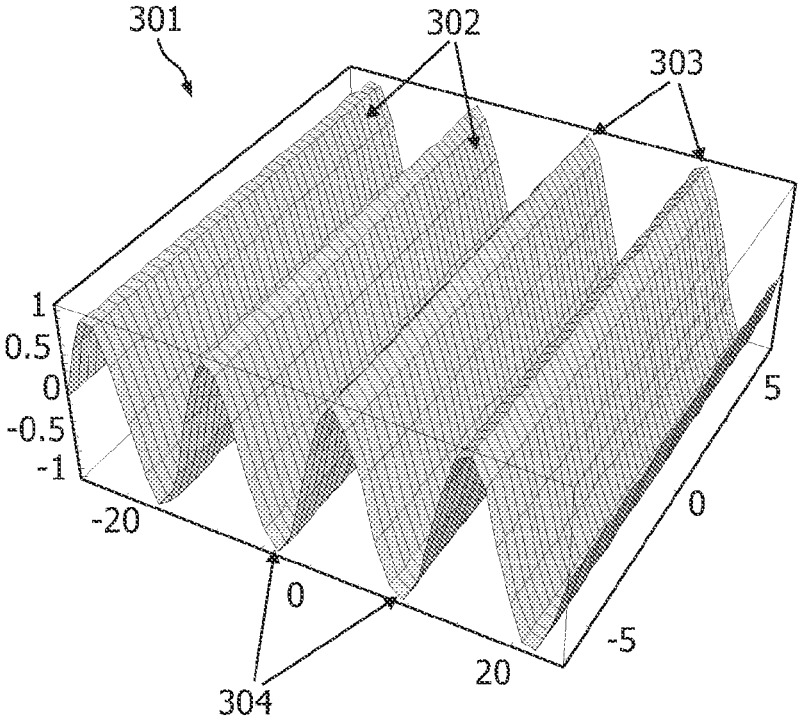
FIG. 3 is a three-dimensional representation of a first example of an undulating surface, having a plurality of sloping regions, elevated regions and depressed regions.

As is shown by FIG. 3, the first example of the undulating surface 301 is formed of a plurality of substantially parallel ridges, which are separated from one another by a series of substantially parallel troughs. These ridges and troughs define the sloping, elevated and depressed regions 302, 303, 304 of the undulating surface 301. It should be noted that, for the purposes of clearly showing the sloping regions 302, the scales of the horizontal and vertical axes in FIG. 3 are substantially different to one another. As such, the gradient of the sloping regions 302 in FIG. 3 is exaggerated.

Figure 2:
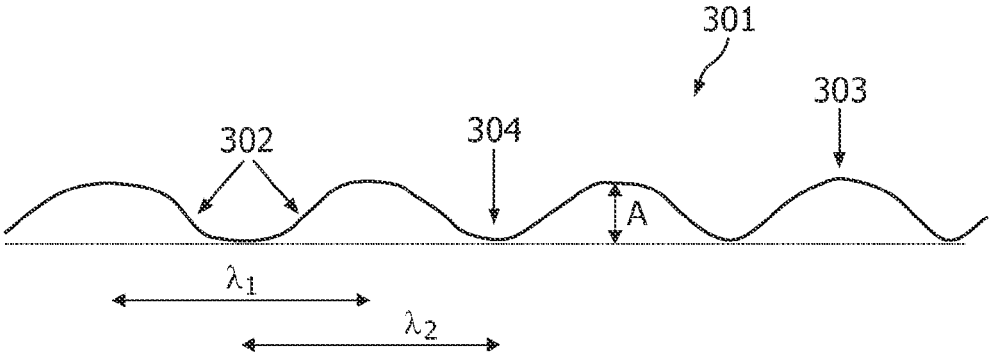
FIG. 2 is a two-dimensional representation of a first example of an undulating surface, having a plurality of sloping regions, elevated regions and depressed regions.

As is shown by the two-dimensional representation of FIG. 2, the cross-section of the undulating surface 301 of this first example may substantially correspond to the form of a sine wave.

The vertical distance between adjacent elevated and depressed regions 303, 304 is represented in FIG. 2 by distance A. An average vertical distance between the elevated regions 303 and depressed regions 304 can be represented in terms of a surface roughness $R_z$, which is the average of the distance, measured along the vertical axis of the elevated and depressed regions 303, 304, between adjacent elevated and depressed regions 303, 304 of the undulating surface 301.

The undulating surface 301 may have a surface roughness $R_z$ of greater than 100 μm, and may have a surface roughness of not less than 120 μm. The undulating surface may also have a distance $\lambda_1$ between adjacent elevated regions 303 in a range between 200 μm and 20 mm. Alternatively, the distance $\lambda_1$ between adjacent elevated regions 303 may be in a range between 200 μm and 3 mm. As a further alternative, the distance $\lambda_1$ between adjacent elevated regions 303 may be in a range between 200 μm and 1 mm. The same set of ranges may also apply to the distance $\lambda_2$ between adjacent depressed regions 304. These ranges may additionally apply to any of the alternative examples of the undulating surface 301 discussed below. As is indicated by FIG. 2, the distances $\lambda_1$, $\lambda_2$ between adjacent elevated regions 303 and depressed regions 304 are measured perpendicular to the axis of the surface roughness depth $R_z$.

The undulating surface 301 is smooth to the touch due to the human finger only sensing the elevated regions 303. The undulating surface 301 also provides the structured area 300 with a very low gliding resistance and increases the similarities in physical appearance between the teat 100 and a mother's breast. The resemblance between the texture, feel and appearance of the teat 100 and the texture, feel and appearance of a mother's breast is thus increased.

When the distances $\lambda_1$, $\lambda_2$ between adjacent elevated regions 303 and depressed regions 304 are in the ranges discussed above, the structured area 300 of the teat 100 may be to some degree transparent. This is convenient for a user of the feeding bottle 200 with which the teat 100 may be being used, for example a child's mother or father, as it allows the interior of the teat 100 to be viewed without having to remove the lid 201 of the feeding bottle 200. The user is therefore able to see when the interior of the teat 100 is dirty and requires cleaning.

Figure 4:
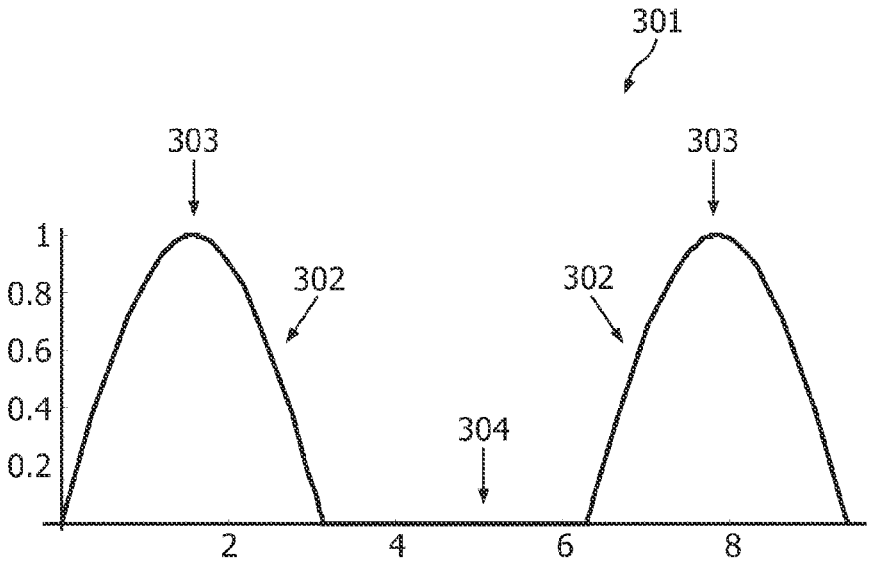
FIG. 4 is a two-dimensional representation of a second example of an undulating surface, having a plurality of sloping regions, elevated regions and depressed regions.
Figure 5:
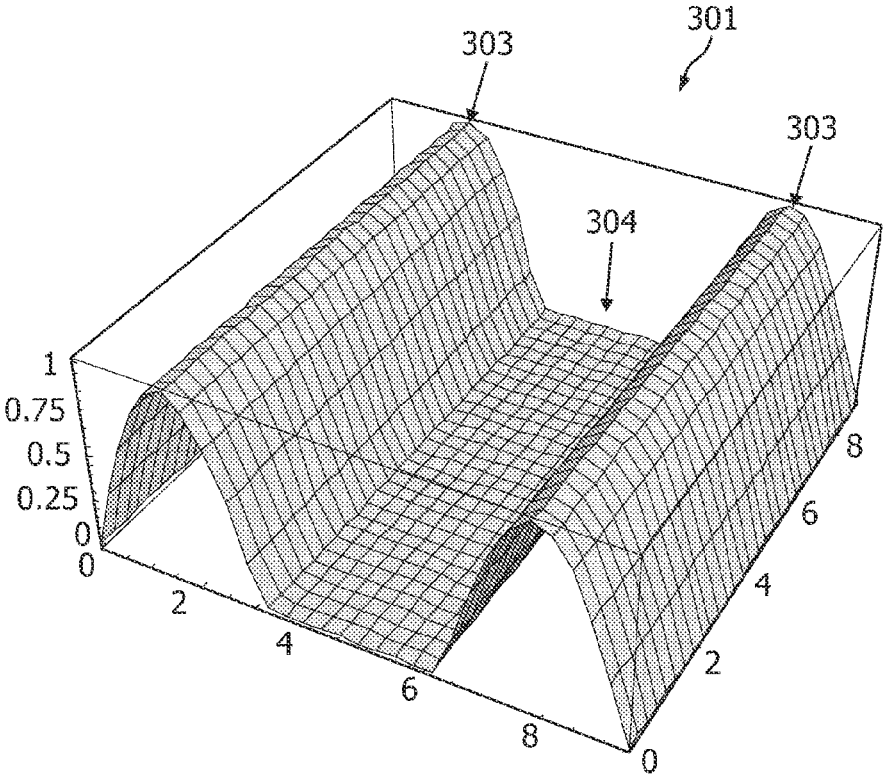
FIG. 5 is a three-dimensional representation of a second example of an undulating surface, having a plurality of sloping regions, elevated regions and depressed regions.

A second example of a section of undulating surface 301 is shown in two-dimensions and three-dimensions by FIG. 4 and FIG. 5 respectively. As with the first example discussed above in relation to FIGS. 2 and 3, the undulating surface 301 comprises a plurality of sloping regions 302, elevated regions 303 and depressed regions 304 defined by a series of parallel ridges and troughs. However, as can be seen from FIGS. 4 and 5, the troughs defining the depressed regions 304 of this second example are substantially wider than the troughs defining the depressed regions 304 in the first example.

Referring to the two-dimensional representation of the undulating surface 301 shown in FIG. 4, the cross-section of the undulating surface 301 of the second example may substantially correspond to a discontinuous sine wave, in which the lower half of the sine wave is replaced by a series of flat sections joining adjacent peaks. As such, each of the troughs defining the depressed regions 304 in this example of the undulating surface 301 comprises a substantially flat base region, which is joined at each of its ends to the sloping regions 302. This example of the undulating surface 301 is advantageous from a manufacturing point of view, as it can be fabricated using a relatively simple mould.

Although FIG. 4 shows the two-dimensional form of the undulating surface 301 as substantially corresponding to the upper half of a sine wave, it will be appreciated that the undulating surface 301 could alternatively correspond to any other proportion of a sine wave. For example, the undulating surface 301 may substantially correspond to the upper quarter or third of a sine wave, with substantially flat sections joining the sloping regions 302.

Figure 6:
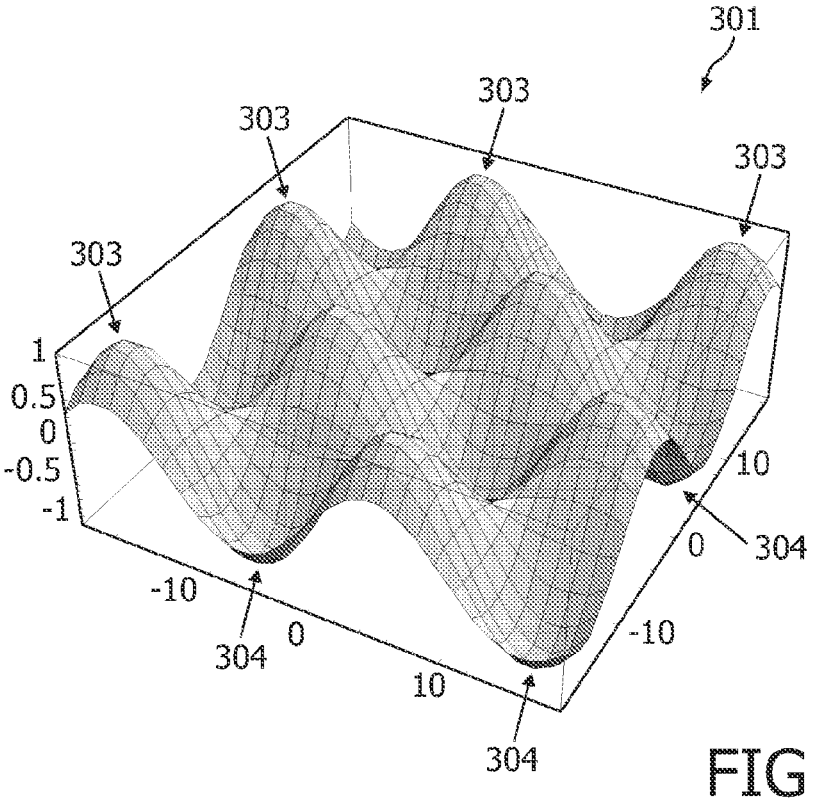
FIG. 6 is a three-dimensional representation of a third example of an undulating surface, having a plurality of sloping regions, elevated regions and depressed regions.

A third example of a section of undulating surface 301 is shown in three dimensions by FIG. 6. As with the examples discussed above, this example of the undulating surface 301 comprises a plurality of sloping regions 302, a plurality of elevated regions 303 and a plurality of depressed regions 304. However, as is shown by FIG. 6, the undulating surface 301 of this example differs from the first and second examples in that the elevated, depressed and sloping regions 302, 303, 304 are defined by a pattern of protrusions and depressions rather than a series of ridges and troughs.

The structure of the pattern of protrusions and depressions which define the elevated, depressed and sloping regions 303, 304, 302 of this example of the undulating surface 301 is described by the following mathematical function:

$$f(x,y)=\text{Sin } ax\cdot\text{Sin } ay \text{ where } a=0.3 \qquad \text{Equation (1)}$$

Each of the units shown on the xy scale in FIG. 6 may correspond to a distance in a range between 60 μm and 300 μm. Hence the example shown in FIG. 6 may have a surface roughness depth $R_z$ in a range between 120 μm and 600 μm. Alternatively, the example shown in FIG. 6 may have a surface roughness depth $R_z$ in a range between 120 μm and 300 μm.

The distance $\lambda_1$ between adjacent elevated regions 303 may be in a range between 1.2 mm and 6 mm. Alternatively, the distance $\lambda_1$ between adjacent elevated regions 303 may correspond to any of the distance ranges discussed in relation to the first example of the undulating surface 301. The same set of ranges may also apply to the distance $\lambda_2$ between adjacent depressed regions 304. As with the first example discussed above, the distances $\lambda_1$, $\lambda_2$ between adjacent elevated regions 303 and depressed regions 304 are measured perpendicular to the axis of the elevated and depressed regions 303, 304 in a manner corresponding to that shown in FIG. 2.

Alternatively, the structure of the protrusions and depressions which define the elevated and depressed regions 303, 304 may correspond to any other combination of the product of Sin x and Sin y. For instance, referring to FIG. 7, a fourth example of a section of an undulating surface 301 is shown in which the structure of the pattern of protrusions and depressions is described by the function:

$$f(x,y)=\mathrm{Sin}(x+y)\cdot\mathrm{Sin}(x-y) \qquad \text{Equation (2)}$$

This example has the advantage that, from whatever angle the undulating surface 301 is viewed, the surface roughness depth $R_z$ and distances $\lambda_1$, $\lambda_2$ are always constant.

Figure 7:
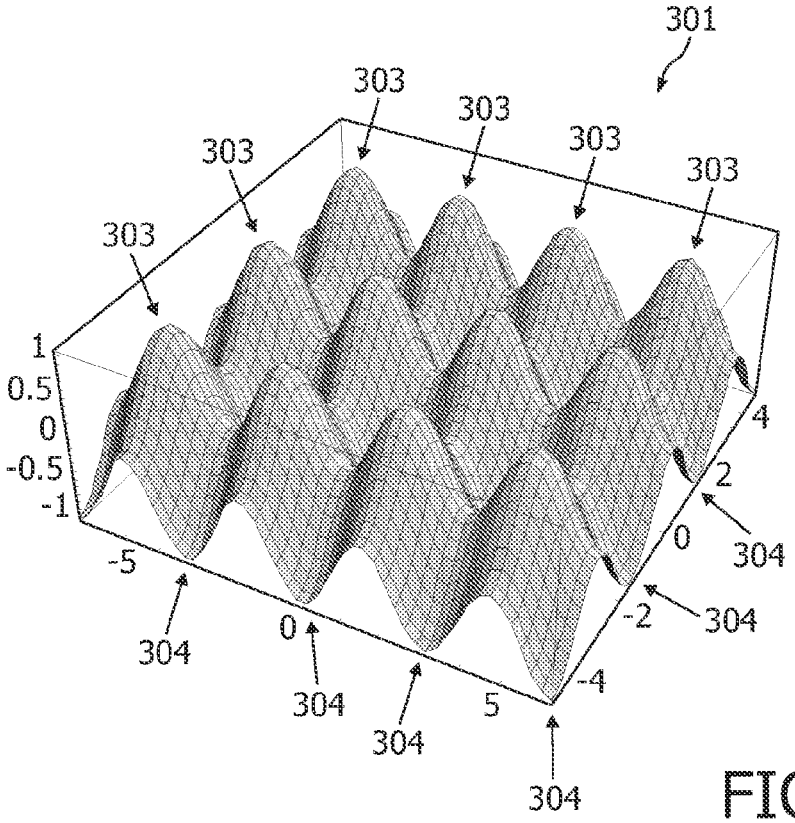
FIG. 7 is a three-dimensional representation of a fourth example of an undulating surface, having a plurality of sloping regions, elevated regions and depressed regions.
Figure 8:
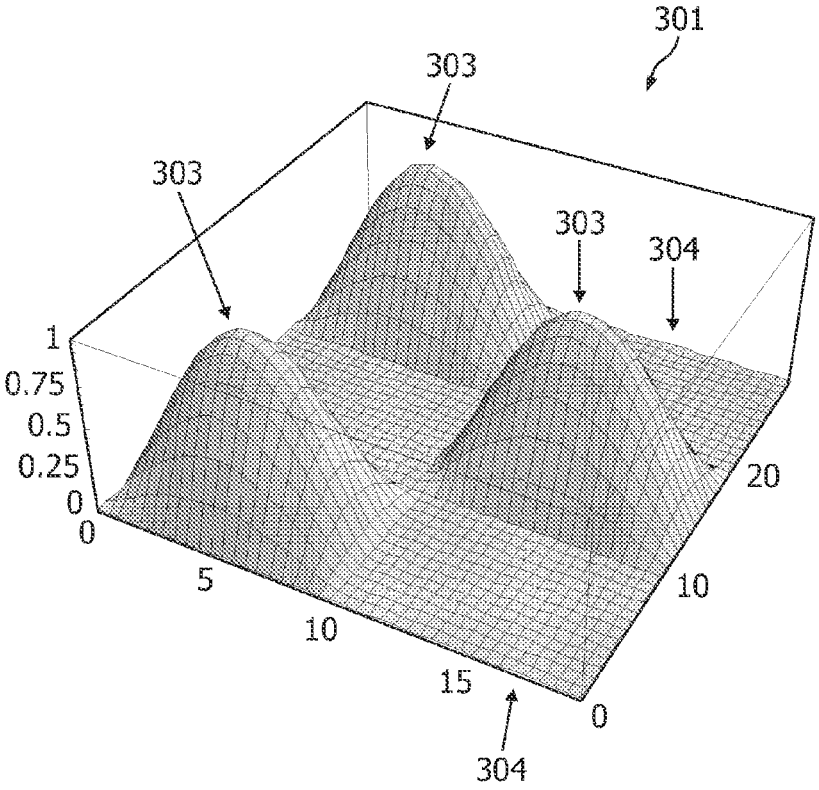
FIG. 8 is a three-dimensional representation of a fifth example of an undulating surface, having a plurality of sloping regions, elevated regions and depressed regions.

A fifth example of a section of an undulating surface 301 is shown in three dimensions in FIG. 8. This example of the undulating surface 301 differs from the third and fourth examples discussed above in that the depressed regions 304 correspond to substantially flat sections which join the sloping regions 302. In this regard, this example of the undulating surface 301 is similar to the second example discussed in relation to FIGS. 4 and 5. The structure of the elevated regions 303 of this example of the undulating surface 301 may correspond to those shown in FIG. 6 or FIG. 7, or may be described by any other combination of the product of Sin x and Sin y as previously discussed. The magnitude of the surface roughness $R_z$ and distances $\lambda_1$, $\lambda_2$ may correspond to any those discussed in the previous examples.

The surface area of the protrusions defining the elevated regions 303 relative to the surface area of the substantially flat sections defining the depressed areas 304 can be varied as described in relation to FIG. 4. There is no requirement for the pattern of protrusions and depressions to be symmetrical as shown in FIG. 8.

Figure 9:
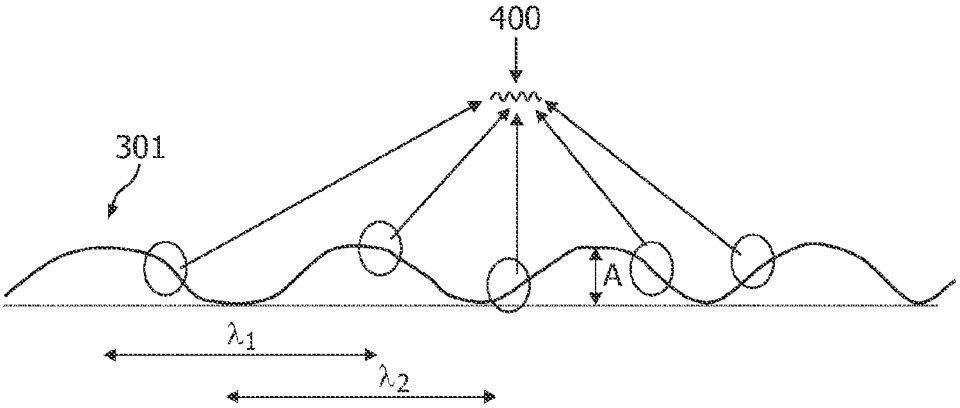
FIG. 9 is a two-dimensional representation of an undulating surface comprising a secondary structured area comprising a secondary undulating surface.
Figure 10:
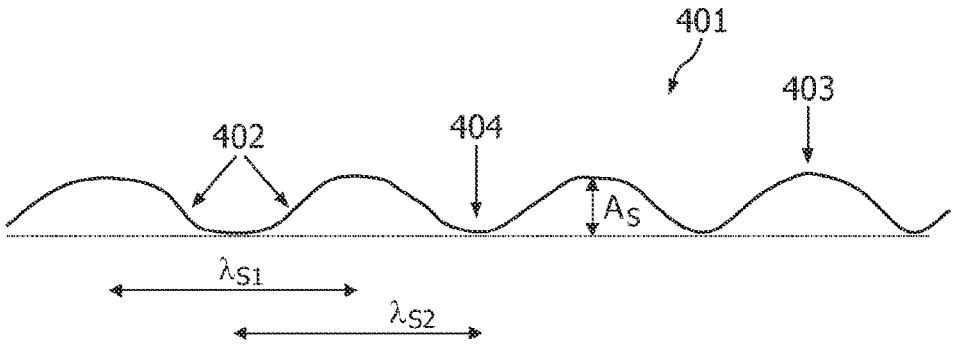
FIG. 10 is a two-dimensional representation of a secondary undulating surface comprising a plurality of sloping regions, elevated regions and depressed regions.

Referring to FIGS. 9 and 10, any of the first to fifth examples of the structured area 300 comprising an undulating surface 301, discussed above in relation to FIGS. 2 to 8, may additionally comprise a secondary structured area 400.

The secondary structured area 400 may be provided on the undulating surface 301, and may comprise a secondary undulating surface 401 including a plurality of sloping regions 402, a plurality of elevated regions 403 and a plurality of depressed regions 404.

The form of the secondary undulating surface 401 may, for example, correspond to the form of any of the examples of the undulating surface 301 discussed above in relation to FIGS. 2 to 8. The surface roughness $R_{sz}$ and distances $\lambda_{S1}$, $\lambda_{S2}$ between adjacent elevated regions 403 and depressed regions 404 of the secondary undulating surface 401 may, however, be smaller than those discussed in relation to the examples of the undulating surface 301.

For example, the distance $\lambda_{S1}$ between adjacent elevated regions 403 may be of 100 μm or less. Alternatively, the distance $\lambda_{S1}$ between adjacent elevated regions 403 may be in a range between 0.1 μm and 400 μm. The distance $\lambda_{S2}$ between adjacent depressed regions 404 may be of an equivalent, or approximately equivalent, value to the distance $\lambda_{S1}$. The surface roughness $R_{sz}$ of the secondary undulating surface 401 may be in a range between 0.2 μm and 10 μm. The definitions of $R_{sz}$, $\lambda_{S1}$ and $\lambda_{S2}$ substantially correspond to the definitions of $R_z$, $\lambda_1$ and $\lambda_2$ given in relation to the first example of the undulating surface 301 discussed above.

The secondary undulating surface 401 may be formed over the entire undulating surface 301, or may be formed over only a partial region thereof.

The combination of the undulating surface 301 and secondary undulating surface 401 further contributes to the overall smooth feel and low gliding resistance of the structured area 300, and increases the resemblance between the texture, feel and appearance of the structured area 300 and the texture, feel and appearance of a mother's breast.

The secondary structured area 400 may be formed during manufacture of the teat 100 using techniques such as sandblasting or chemical etching. The location of the secondary structured area 400 may be at the nipple 102 of the teat 100, such that the area 400 is in contact with the mouth of the baby or child during feeding.

In relation to all examples of the undulating surface 301 and secondary undulating surface 401 discussed above, the geometric properties of the elevated regions 303, 403 and depressed regions 304, 404 may be substantially uniform as is shown, for example, in FIGS. 6 and 7. It should be noted, however, that this is not a requirement of the invention. The elevated regions 303, 403 of any particular example may vary in height and width, and may also be of varying distances apart from one another. The same is true of the depressed regions 304, 404.

Figure 11:
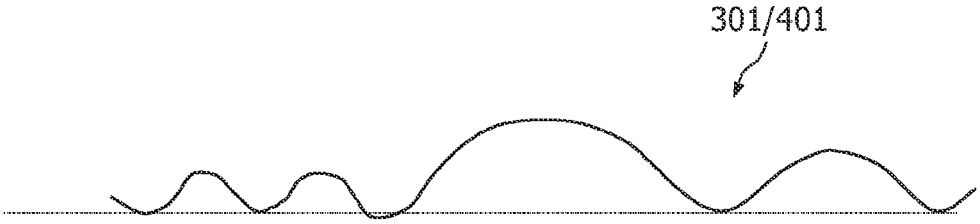
FIG. 11 is a two-dimensional representation of an undulating surface or secondary undulating surface comprising a plurality of sloping regions, elevated regions and depressed regions having varying geometric properties.

An example of an undulating surface 301 or secondary undulating surface 401 exhibiting such varying geometric properties is shown in FIG. 11.

The interior surface 105 of the teat 100 may comprise a plurality of strengthening elements, for example comprising standard ribbed sections as known in the art. The interior surface 105 of the teat 100 may otherwise be of a substantially flat profile.

Figure 12:
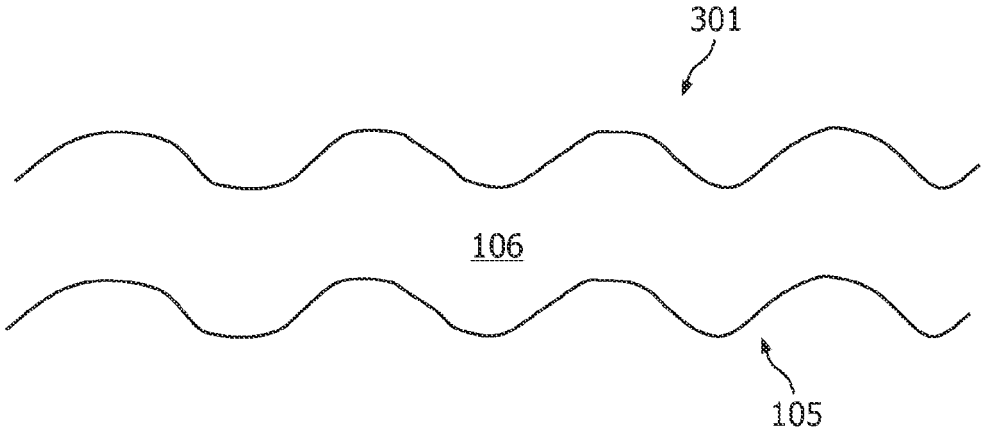
FIG. 12 is a two-dimensional representation of the substantially matching profiles of an exterior surface and interior surface of a wall of a teat.

Alternatively, the profile of the inner surface 105 of the teat 100 may be of any other form. For example, the profile of the interior surface 105 of the teat 100 may undulate so as to follow the profile of the undulating surface 301 of the structured area 300 on the exterior surface 104 of the teat 100, thus keeping the wall 106 of the teat 100 at a constant, or substantially constant, thickness. This is shown in FIG. 12. Creating a teat wall 106 of substantially constant thickness in this manner may increase the strength and durability of the teat 100, and thus may be advantageous.

The teat 100 may be manufactured as a complete unit, for example using a mould, from any suitable material. Suitable materials may include, for example, silicone, latex or thermoplastic elastomers (TPE) such as TPE-A or TPE-S. The Shore hardness of the teat 100 may be in a range between 5 and 70 Shore A. Alternatively, the Shore hardness may be in a range between 30 and 50 Shore A.

Figure 13:
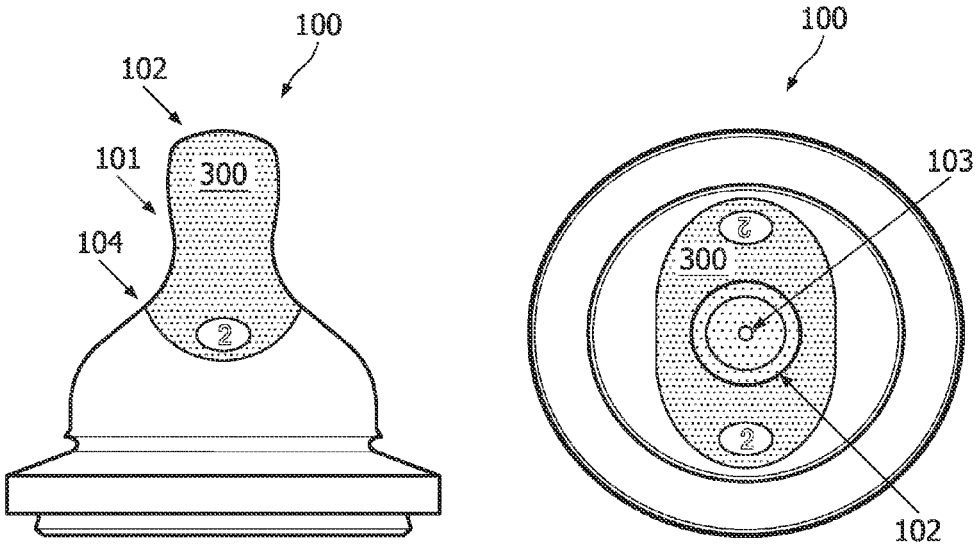
FIG. 13 is a side-view and a plan-view of a teat having a stem, nipple and structured area.
Figure 14:
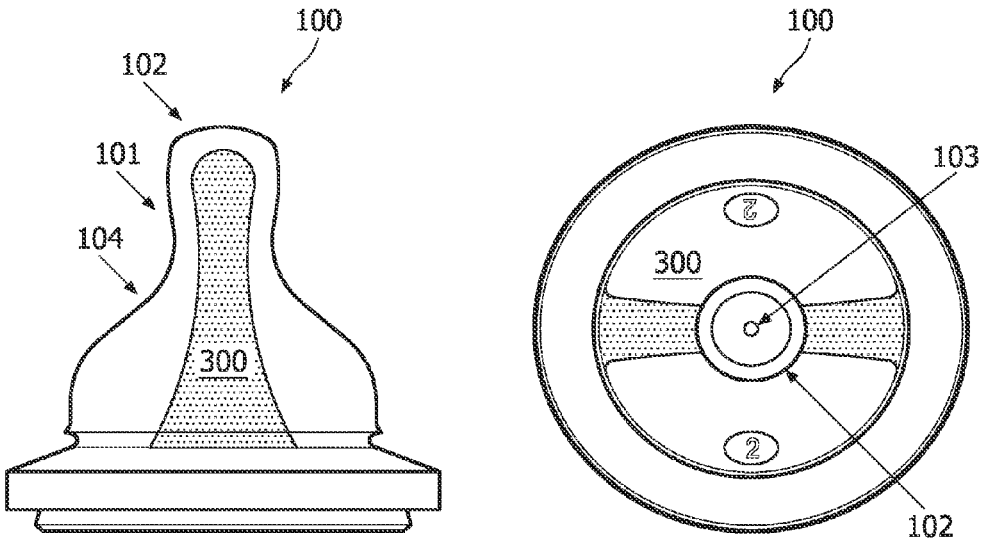
FIG. 14 is a side-view and a plan-view of a teat having a stem, nipple and structured area.
Figure 15:
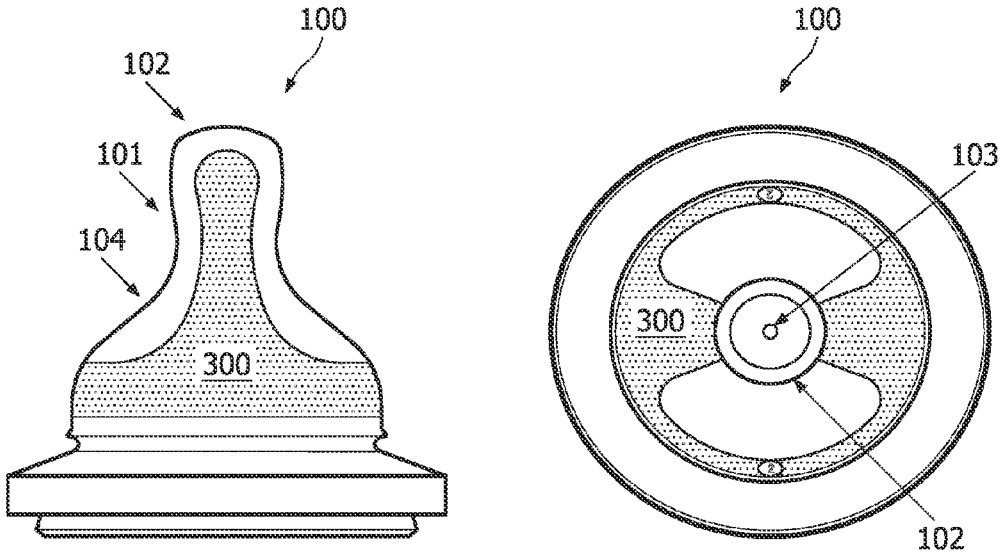
FIG. 15 is a side-view and a plan-view of a teat having a stem, nipple and structured area.

Referring again to FIG. 1, a first example coverage region of the structured area 300 on the exterior surface 104 of the teat 100 is shown. FIGS. 13 to 15 show second, third and fourth example coverage regions of the structured area 300. As can be seen, in all of these examples, the structured area 300 is provided on at least a partial region of the stem 101 or nipple 102. The areas of the exterior surface 104 of the stem 101 or nipple 102 on which the structured area 300 is not provided may be substantially smooth.

Although the teat 100 has been described in relation to supplying milk or fluid to humans, it will be appreciated that the teat 100 could alternatively be used for supplying milk to other mammals. In addition, although the teat 100 has been substantially discussed in relation to feeding, it will be appreciated that it is equally applicable for use with a pacifier or other products which are to be used orally by a child.

Although claims have been formulated in this application to particular combinations of features, it should be understood that the scope of the disclosure of the present invention also includes any novel features or any novel combination of features disclosed herein either explicitly or implicitly or any generalisation thereof, whether or not it relates to the same invention as presently claimed in any claim and whether or not it mitigates any or all of the same technical problems as does the present invention. The applicants hereby give notice that new claims may be formulated to such features and/or combinations of such features during the prosecution of the present application or of any further application derived therefrom.

The invention claimed is:

1. A teat comprising a stem and a nipple, wherein a structured area comprising a primary undulating surface is provided on at least a partial region of the stem or nipple, wherein the primary undulating surface is sinusoidal and has a surface roughness Rz of greater than 100 μm, wherein the primary undulating surface comprises elevated regions and depressed regions, and wherein the primary undulating surface comprises one or more secondary structured areas located only along the sinusoidal shape of the primary undulating surface, wherein the one or more secondary structured areas comprise a secondary undulating surface comprising a plurality of sloping regions, a plurality of elevated regions and a plurality of depressed regions, wherein an average distance between adjacent elevated regions of the primary undulating surface is greater than an average distance between adjacent elevated regions of the secondary undulating surface; and wherein a height between an elevated region and a depressed region of the secondary undulating surface is less than a height between an elevated region and a depressed region of the primary undulating surface.

2. The teat according to claim 1, wherein an average distance between adjacent elevated regions of the secondary undulating surface is 100 μm or less.

3. The teat according to claim 1, wherein the elevated regions of the secondary undulating surface have varying geometric properties including different heights.

4. The teat according to claim 1, wherein the teat is adapted to cooperate with a feeding bottle.

* * * * *